US010926294B2

(12) United States Patent
Felton et al.

(10) Patent No.: US 10,926,294 B2
(45) Date of Patent: Feb. 23, 2021

(54) VIBRATORY MATERIAL CLASSIFIER

(71) Applicant: Superior Industries, Inc., Morris, MN (US)

(72) Inventors: Jarrod Felton, Morris, MN (US); Lafe Grimm, Hancock, MN (US)

(73) Assignee: Superior Industries, Inc., Morris, MN (US)

( * ) Notice: Subject to any disclaimer, the term of this patent is extended or adjusted under 35 U.S.C. 154(b) by 907 days.

(21) Appl. No.: 15/602,625

(22) Filed: May 23, 2017

(65) Prior Publication Data

US 2017/0333949 A1 Nov. 23, 2017

Related U.S. Application Data

(60) Provisional application No. 62/462,394, filed on Feb. 23, 2017, provisional application No. 62/340,394, filed on May 23, 2016.

(51) Int. Cl.

| | |
|---|---|
| ***B07B 1/28*** | (2006.01) |
| ***B07B 1/36*** | (2006.01) |
| *B07B 1/42* | (2006.01) |

(52) U.S. Cl.

CPC ..... *B07B 1/284* (2013.01); *B07B 1/36* (2013.01); *B07B 1/42* (2013.01); *B07B 2201/04* (2013.01)

(58) Field of Classification Search

CPC ..... B07B 1/284; B07B 1/36
USPC ..... 209/326
See application file for complete search history.

(56) References Cited

U.S. PATENT DOCUMENTS

| | | | | |
|---|---|---|---|---|
| 2,914,175 | A * | 11/1959 | Fink | B07B 1/00 209/269 |
| 3,442,381 | A | 5/1969 | Johnson | |
| 3,491,881 | A | 1/1970 | Winquist | |
| 3,771,374 | A | 11/1973 | Choules | |
| 3,772,923 | A | 11/1973 | Burt | |
| 3,926,793 | A * | 12/1975 | Wise | B03B 5/02 209/426 |
| 4,137,159 | A | 1/1979 | Sawyer | |
| 4,139,287 | A * | 2/1979 | Wessinger | G03B 23/00 33/389 |
| 4,165,655 | A | 8/1979 | Alford | |
| 4,170,549 | A | 10/1979 | Johnson | |

(Continued)

FOREIGN PATENT DOCUMENTS

| | | |
|---|---|---|
| AU | 2007271669 A1 | 1/2008 |
| AU | 2007271669 B2 | 1/2008 |

(Continued)

OTHER PUBLICATIONS

Deister Machine Company, Inc., Type HM-2816 Serial No. 2003000 Deister Vibrating Equipment, Operating and Parts Manual, 2015, pp. 1-61, Deister Machine Company, Inc., Fort Wayne, Indiana.

(Continued)

*Primary Examiner* — Charles A Fox
*Assistant Examiner* — Michael E Butler
(74) *Attorney, Agent, or Firm* — Todd R. Fronek; Larkin Hoffman Daly & Lindgren Ltd.

(57) ABSTRACT

Vibratory material classifiers are disclosed. Some embodiments include eccentric shaft assemblies having removable eccentric weights. Some embodiments include oil access and indicator conduit extending from the interior to the exterior of a classifier.

20 Claims, 14 Drawing Sheets

(56) References Cited

U.S. PATENT DOCUMENTS

| | | | | |
|---|---|---|---|---|
| 4,211,121 | A | 7/1980 | Brown | |
| 4,340,469 | A | 7/1982 | Archer | |
| 4,632,751 | A * | 12/1986 | Johnson | B07B 1/42 198/770 |
| 5,494,173 | A * | 2/1996 | Deister | B07B 1/42 209/326 |
| 6,386,375 | B1 * | 5/2002 | Olsen | B07B 1/42 209/326 |
| 6,889,846 | B2 * | 5/2005 | Olsen | B07B 1/46 209/309 |
| 6,918,492 | B2 * | 7/2005 | Ostergaard | B07B 1/42 209/326 |
| 2010/0038291 | A1 * | 2/2010 | Sauser | B07B 1/286 209/341 |
| 2010/0314299 | A1 | 12/2010 | Botton et al. | |
| 2012/0125824 | A1 | 5/2012 | Niklewski | |
| 2017/0333949 | A1 * | 11/2017 | Felton | B07B 1/284 |

FOREIGN PATENT DOCUMENTS

| | | | |
|---|---|---|---|
| CN | 101082373 | A | 12/2007 |
| CN | 203146823 | U | 8/2013 |
| CN | 203155528 | U | 8/2013 |
| CN | 203214635 | U | 9/2013 |
| CN | 105944963 | A | 9/2016 |
| WO | 2014079925 | A1 | 5/2014 |

OTHER PUBLICATIONS

Deister Machine Company, Inc., Heavy Duty Inclined Vibrating Screens, Brochure, 2008, pp. 1-16, Bulletin No. 300-D, Deister Machine Company, Inc., Fort Wayne, Indiana.

Deister Machine Company, Inc., Heavy Duty Horizontal Triple Shaft Vibrating Screens, Brochure, 2000, pp. 1-8, Bulletin No. 333-A, Deister Machine Company, Inc., Fort Wayne, Indiana.

Metso Minerals, Nordberg IS Series Screens, Manual, 2008, pp. 1-56, Metso Minerals, Columbia, South Carolina.

Telsmith, Telsmith Vibrating Equipment, Brochure, 2009, pp. 1-10, Telesmith, Mequon, Wisconsin.

Terex Minerals Processing Systems, M Series DM Series Inclined Screens, Terex Simplicity DM (Dual Mechanism) Inclined Screens, Brochure, Mar. 2011, pp. 1-8, Terex Minerals Processing Systems, USA.

W.S. Tyler Canada LTD, F-Class Four Bearing Vibrating Screen, Technical Specifications, admitted prior art, pp. 1-23, Ontario, Canada.

* cited by examiner

VIBRATORY MATERIAL CLASSIFIER

BACKGROUND

Vibratory material classifiers (e.g., incline and horizontal vibratory screens) are used to classify materials (e.g., aggregate materials). Some such classifiers include eccentric shafts for excitation of vibratory motion (e.g., linear, circular, elliptical, etc.) of the classifier. Some such eccentric shafts are operably supported on lubricated bearings.

DESCRIPTION

Vibratory material classifier embodiments are disclosed herein. Some embodiments include eccentric shaft assemblies having removable eccentric weights. Some embodiments include oil access and indicator conduit extending from the interior to the exterior of a classifier.

Figure 1:
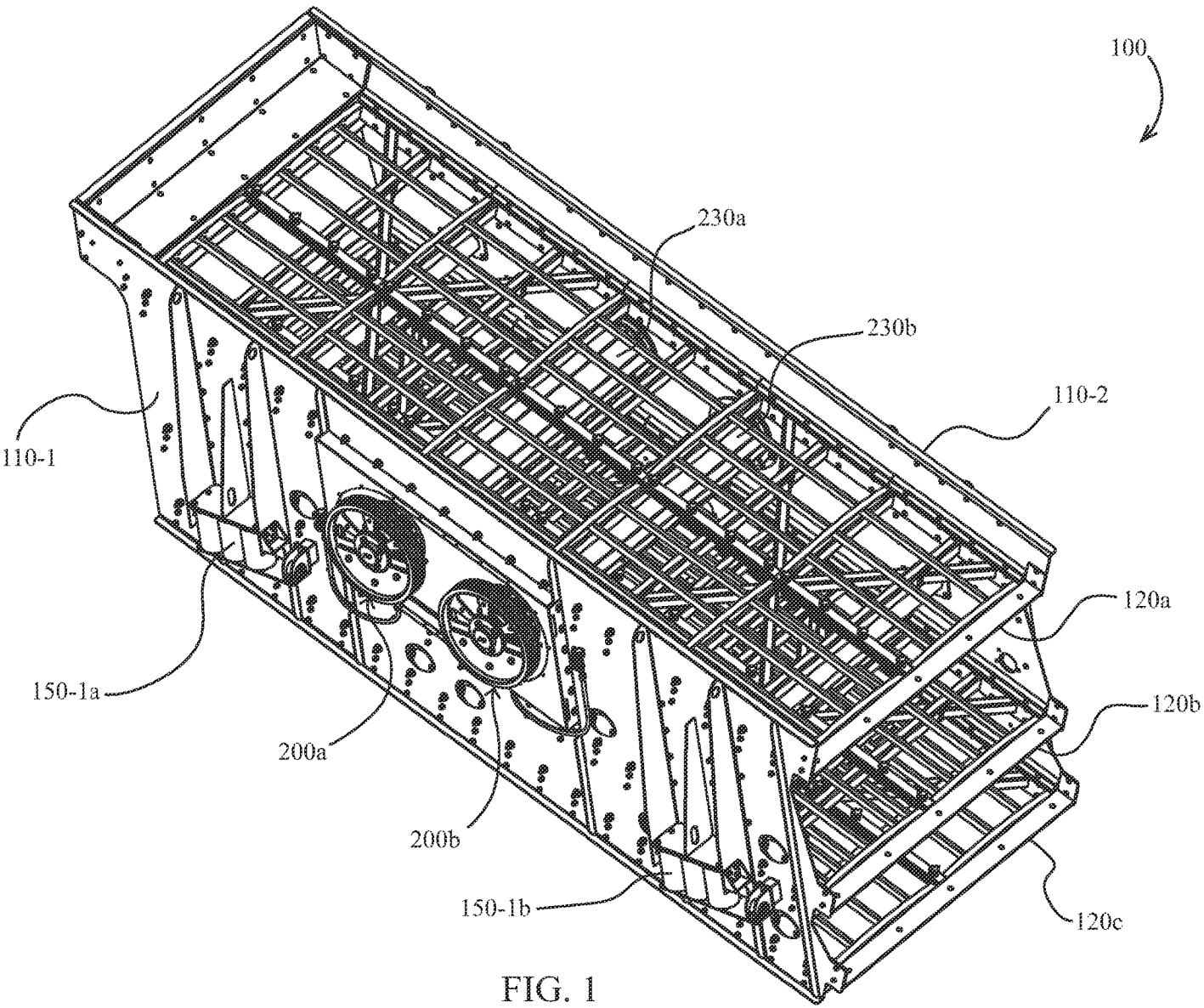
FIG. 1 is a perspective view of an embodiment of a vibratory screen.

Referring to the drawings, wherein like reference numerals designate identical or corresponding parts throughout the several views, FIG. 1 illustrates an embodiment of a vibratory material classifier 100. Although the illustrated classifier 100 is an incline screen, in other embodiments the screen is another type of vibratory classifier (e.g., horizontal screen, grizzly feeder in which a screening deck may comprise a set of grizzly bars, etc.) and/or a screen having a different deck configuration. In the illustrated embodiment, the classifier 100 has a plurality of screening decks 120 (e.g., three decks 120*a*, 120*b*, 120*c*). Each deck 120 is optionally overlaid with removable screen media (not shown) or other classifying media. The classifier 100 is optionally resiliently supported on one or more spring assemblies 150 (e.g., spring assemblies 150-1*a* and 150-1*b* operably supporting sidewall 110-1 and spring assemblies 150-2*a* and 150-2*b* operably supporting sidewall 110-2). One or more drive assemblies 200 (e.g., a rearward drive assembly 200*a* and forward drive assembly 200*b*) are optionally supported by the sidewalls 110-1, 110-2.

Figure 2:
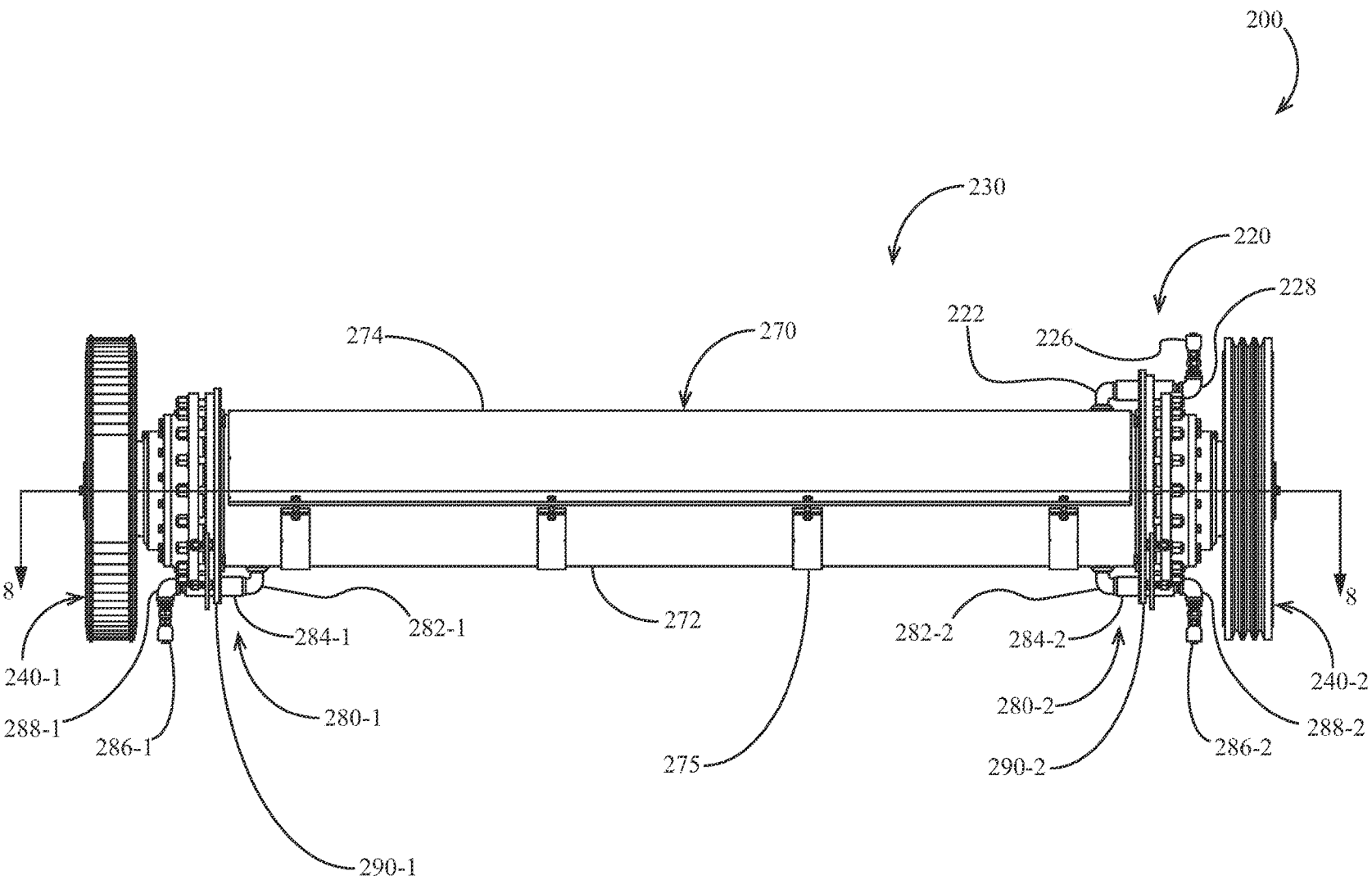
FIG. 2 is a front elevation view of an embodiment of a drive assembly.
Figure 3:
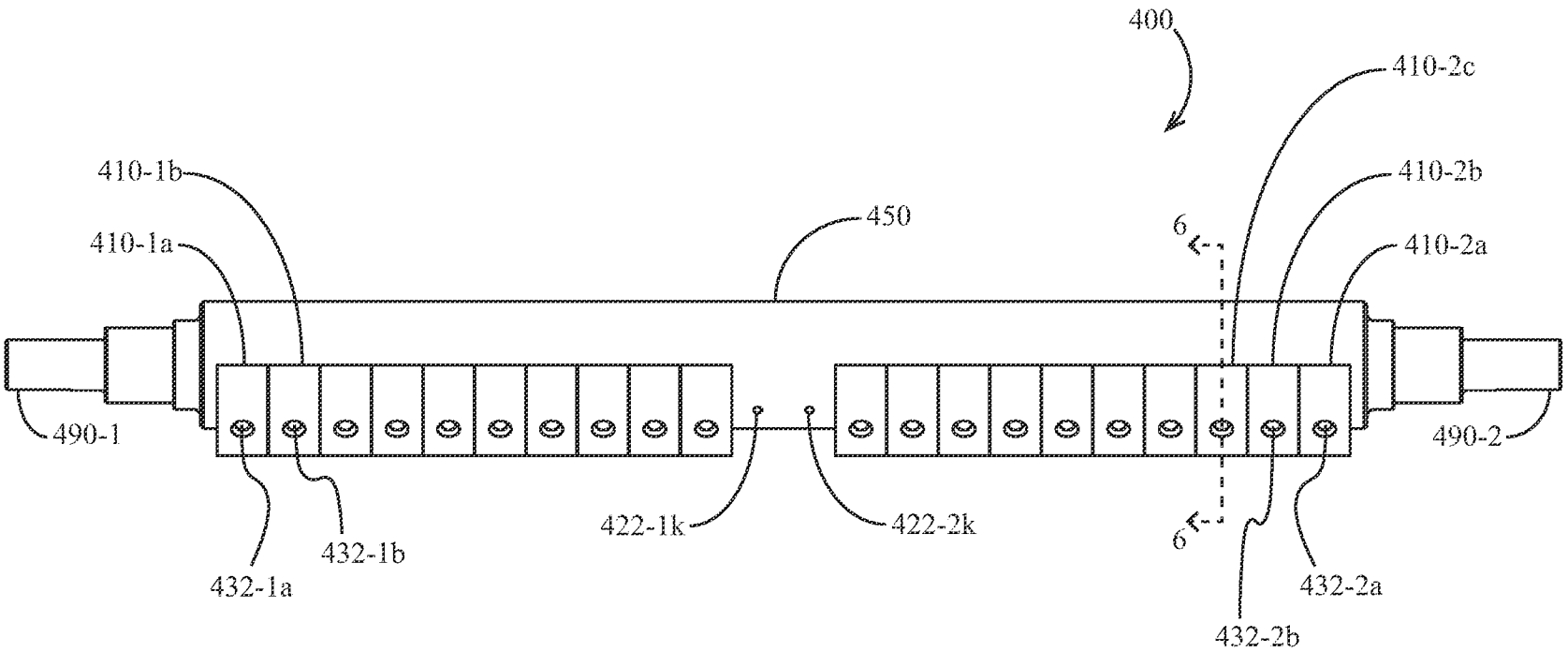
FIG. 3 is a front elevation view of an embodiment of an eccentric shaft assembly.

With further reference to FIG. 2, each drive assembly includes an internal portion 230 extending between sidewalls 110-1, 110-2. The drive assemblies 200 optionally include one or more eccentric portions such that rotation of the drive assembly causes vibratory movement (e.g., circular, elliptical, linear, etc.) of the classifier 100. A sheave 240 is optionally driven by a motor (not shown) (e.g., using a belt) in order to drive rotation of the drive assembly 200. The sheave 240 is optionally disposed outside the sidewalls 110-1, 110-2 as illustrated.

Figure 8:
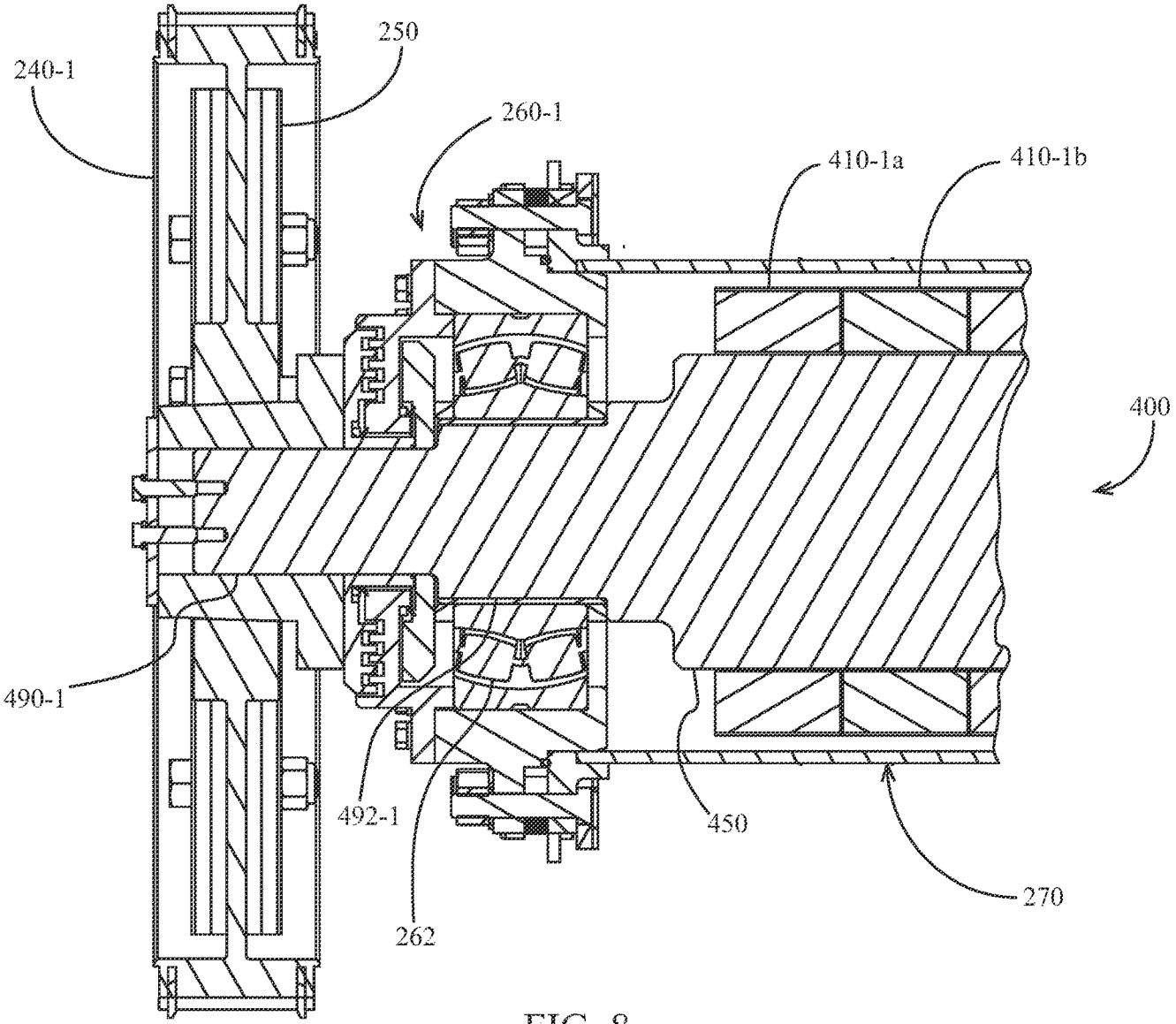
FIG. 8 is partial cross-sectional view along the section 8-8 of FIG. 2.

Referring to FIGS. 2 and 8, the drive assembly 200 is illustrated in more detail according to some embodiments. The drive assembly optionally includes one or more sheaves 240 (e.g., 240-1, 240-2). One of the sheaves 240 (e.g., sheave 240-2) is optionally driven (e.g., using a belt such as a v-belt driven by a motor) for rotation. The other sheave (e.g., sheave 240-1) optionally rotates with the driven sheave. One or both sheaves 240 optionally includes a removable and/or adjustable weight 250. The weight 250 may comprise one or more selectively installed weights such as flat, semi-circular metal weights.

As further illustrated in FIGS. 3 to 8, A shaft 400 optionally extends between the first and second sheaves 240. The shaft 400 optionally includes a first end 490-1 coupled to (e.g., rigidly mounted to) to the first sheave 240-1. The shaft 400 optionally includes a second end 490-2 coupled to (e.g., rigidly mounted to) the second sheave 240-2. In some embodiments, the shaft 400 includes shoulders 492-1, 492-2 disposed inboard of the first and second ends 490-1, 490-2, respectively. Each shoulder 492 is optionally rotatably supported by an associated bearing assembly 260 (e.g., comprising a plurality of roller elements 262 disposed circumferentially about the shoulder). In some embodiments, each shoulder 492 has a diameter greater than the diameter of the associated end 490 of the shaft. Each bearing assembly 260 optionally includes a flange 290 which is optionally mounted (e.g., removably mounted such as by bolts) to an associated sidewall 110.

The shaft 400 optionally includes a central portion 450 disposed between the bearings 260-1, 260-2. The central portion 450 of the shaft 400 is optionally disposed at least partially inside a housing 270 (e.g., a casing, shell, cover, or other structure configured to contain a quantity of lubricant therein). Lubricant (not shown) such as oil or grease optionally at least partially fills an interior volume of housing 270. In some embodiments, the housing 270 comprises a lower arcuate portion 272 removably mounted to an upper arcuate portion 274. In some embodiments, one or more reinforcing ribs 275 are removably mounted to the lower arcuate portion 272 and/or the upper arcuate portion 274. In other embodiments, the housing 270 comprises a unitary structure (e.g., a cylinder).

Some embodiments include one or more lubricant drains 280 (e.g., conduits and/or conduit assemblies which may include rigid or flexible components according to various embodiments) on one or both sides of the central portion 450. Some embodiments include a first lubricant drain 280-1 on a first side of the central portion 450 and a second lubricant drain 280-2 on a second side of the central portion. Each lubricant drain 280 is optionally in fluid communication with the housing 270 (e.g., a lower end thereof such as the bottom of lower arcuate portion 274). Each lubricant drain 280 is optionally in fluid communication with the housing 270 at a first end 282 of the lubricant drain. The first end 282 of the lubricant drain is optionally disposed between the sidewalls 110. Each lubricant drain 280 optionally includes a second end 286 in fluid communication with the first end 282. The second end 286 of the lubricant drain 280 is optionally disposed outside of the sidewalls 110 (e.g., one sidewall may be disposed between the second end of the lubricant drain and another sidewall). In some embodiments, the second end 286 comprises a valve (e.g., a poppet valve, butterfly valve, on-off valve, selectively closeable valve, etc.) and/or connector such quick coupling. The second end 286 is optionally in fluid communication with a valve and/or an outlet which may be moved between positions below or above the level of oil in the housing 270. In such embodiments, the lubricant drain 280 thus permits oil in the housing 270 to be selectively drained by an operator outside the sidewalls 110; additionally or alternatively, the lubricant drain permits oil in the housing 270 to be selectively drained to a position outside the sidewalls 110.

In some embodiments, the lubricant drain 280 (e.g., an intermediate portion 284 thereof) extends through a sidewall 110 (e.g., the sidewall adjacent to the first end 282 of the lubricant drain). In some embodiments, the lubricant drain 280 (e.g., the intermediate portion 284) extends through an opening (e.g., hole, notch, etc.) in the flange 290 (which flange is optionally supported on the sidewall 110 such as by being mounted to an opening in the sidewall 110). In other embodiments, the lubricant drain 280 extends through other mounting structure and/or through an opening in sidewall 110 disposed radially inside or outside the circumference of the flange 290.

In some embodiments, the first end 282 of the lubricant drain 280 optionally comprises a conduit (e.g., elbow) fluidly coupling the housing 270 to the intermediate portion 284. The first end 282 optionally has a downwardly extending inlet and a horizontally extending outlet The intermediate portion 284 optionally comprises a conduit such as a horizontally extending conduit. The intermediate portion 284 is optionally fluidly coupled to the second end 286 by an elbow 288 (e.g., having a horizontally extending inlet and downwardly extending outlet). The second end 286 is optionally disposed below the first end 282 such that oil flows by gravity from the first end 282 to the second end 286.

Figure 10:
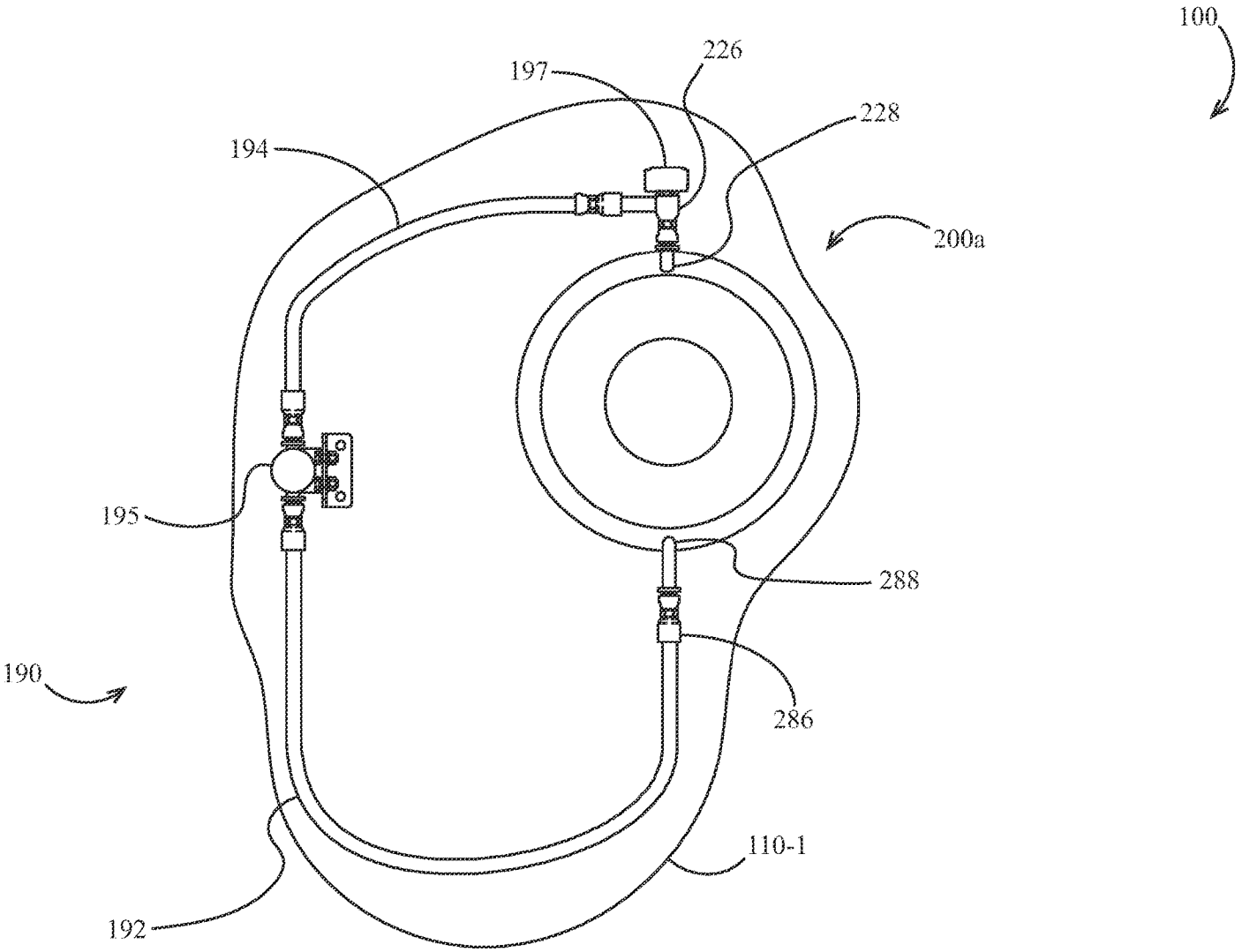
FIG. 10 is a partial side elevation view of another embodiment of a lubricant maintenance system.

Referring also to FIG. 10, an embodiment of an oil maintenance assembly 190 is illustrated. The oil maintenance assembly 190 is optionally disposed at least partially outside the sidewall 110. The oil maintenance assembly 190 optionally comprises a first conduit 192 (e.g., a flexible conduit such as a flexible tube) in fluid communication with the second end 286 of the drain 280. The first conduit 192 is optionally in fluid communication with an upper port 220.

The upper port 220 is optionally in fluid communication with the internal volume of the housing 270 (e.g., an upper portion thereof which optionally contains an air space). Referring to FIG. 2, the upper port 220 is optionally generally of similar construction to the drain 280. The upper port 220 optionally includes a first end 222 in fluid communication with the upper end of the housing 270. The upper port 220 optionally comprises a second end 226 in fluid communication with the first end 222. The upper port 220 (e.g., an intermediate portion thereof) optionally extends through the sidewall 110 and/or through the flange 290. An elbow 228 optionally fluidly couples the second end 286 to the intermediate portion. The second end 226 of the upper port 220 is optionally disposed outside the sidewalls 110.

Returning to FIG. 10, in some embodiments the conduit 192 is optionally in fluid communication with a level indicator 195 (e.g., a sight glass or other level indicator). The level indicator 195 is optionally mounted (e.g., removably mounted to a bracket) on the exterior of sidewall 110. The level indicator 195 is optionally disposed at a height generally approximate to the height of oil in the housing 270 such that the level of oil in the housing 270 may be visualized using the level indicator 195. A conduit 194 (e.g., flexible conduit) optionally fluidly couples the level indicator 195 to the upper port 220 (e.g., the second end 226 thereof). In some embodiments, the level indicator 195 is omitted and/or the flexible conduit 192 is directly fluidly coupled to the upper port 220. In some embodiments, a breather 197 is in fluid communication with the upper port 220 (e.g., with the second end 226 thereof). In some maintenance implementations, oil may be drained from the housing 270 by disconnecting the conduit 192 from the second end 286 of the lubricant drain 280 and/or from the level indicator 195. In some maintenance implementations, oil may be added to and/or circulated through the housing 270 by connecting the conduit 192 and/or conduit 194 to a source of oil (e.g., to an oil circulating pump).

Figure 9:
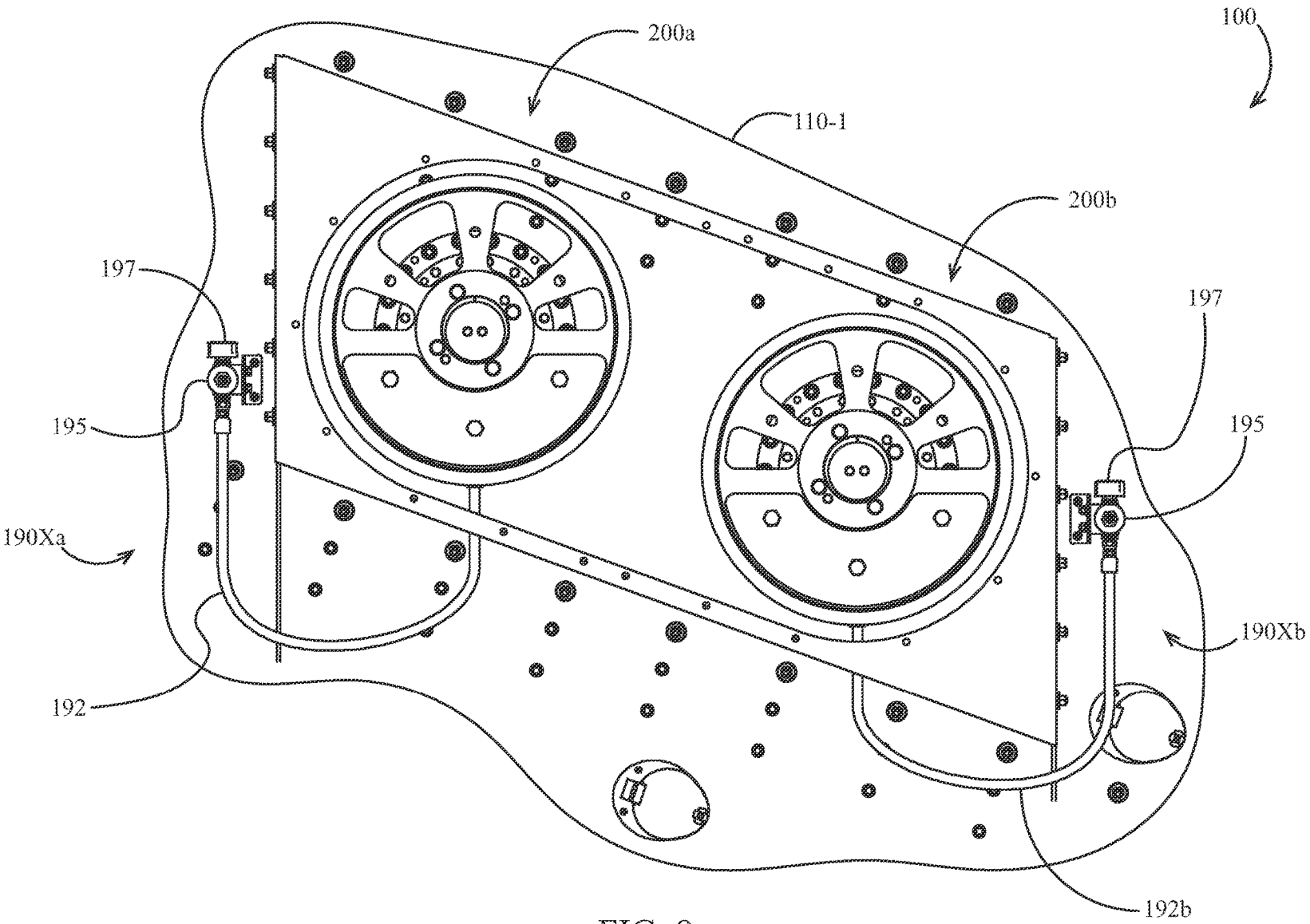
FIG. 9 is a partial side elevation view of an embodiment of a lubricant maintenance system.

Referring to FIG. 9, another embodiment of an oil maintenance assembly 190X is illustrated. As may be the case with the other oil maintenance assembly embodiments described herein, separate oil maintenance assemblies 190Xa, 190Xb are associated with each drive assembly 200*a*, 200*b*, respectively. In the oil maintenance assembly 190X, the breather 197 is coupled to and/or in fluid communication with the level indicator 195. The upper port 220 is optionally omitted in the drive assembly embodiment used with the maintenance assembly 190X.

Referring to FIGS. 11-14, another embodiment of a classifier 100A is illustrated having features which may be similar or identical to other classifier embodiments described herein except as described with respect to FIGS. 11-14.

Figure 11:
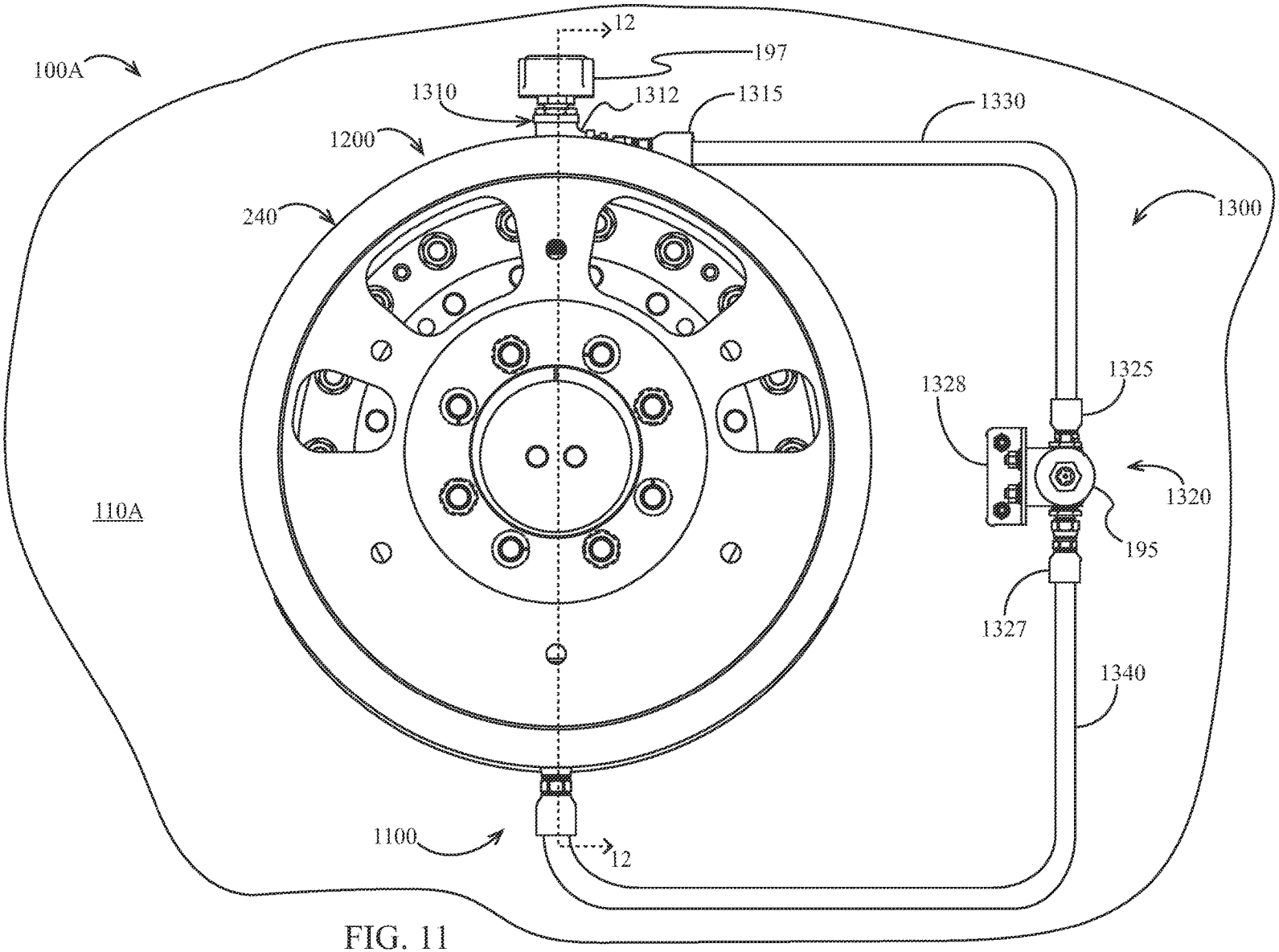
FIG. 11 is a partial side elevation view of another embodiment of a classifier.

Referring to FIG. 11, the classifier 100A, the classifier 100A optionally comprises a maintenance assembly 1300. The maintenance assembly 1300 optionally comprises a breather assembly 1310 (which may be described as a port) in fluid communication with a fluid coupling 1100. It should be appreciated that the fluid coupling 1100 may be used to allow lubricant to escape from housing 270 by gravity, and in some embodiments and/or implementations the fluid coupling 1100 maybe used to remove lubricant from, add lubricant to, or circulate lubricant to and from the housing 270 by gravity and/or by the use of the pump. In some alternative embodiments, the fluid coupling 1100 (e.g., an outlet thereof) is disposed at least partially above the bottom of the housing 270. In some embodiments, a breather 197 of the breather assembly 1320 is optionally disposed above the housing 270. In some embodiments, the breather assembly is optionally supported on a bearing assembly 1200. In some embodiments, a level indicator assembly 1320 (e.g., including a level indicator 195 such as a sight glass) is optionally in fluid communication with the breather assembly 1310 and/or the fluid coupling 1100.

Figure 12:
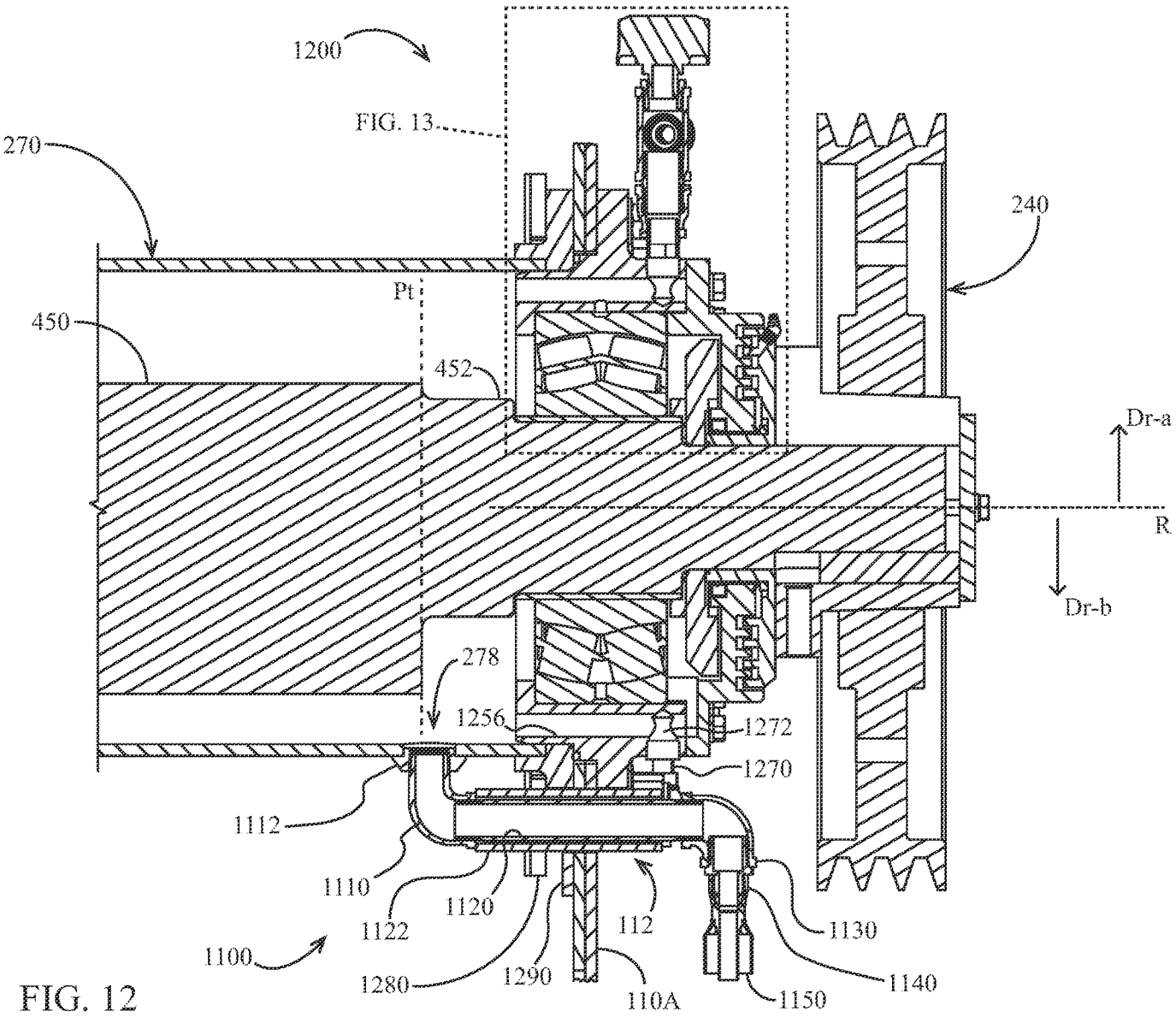
FIG. 12 is a cross-sectional view along the section 12-12 of FIG. 11.
Figure 13:
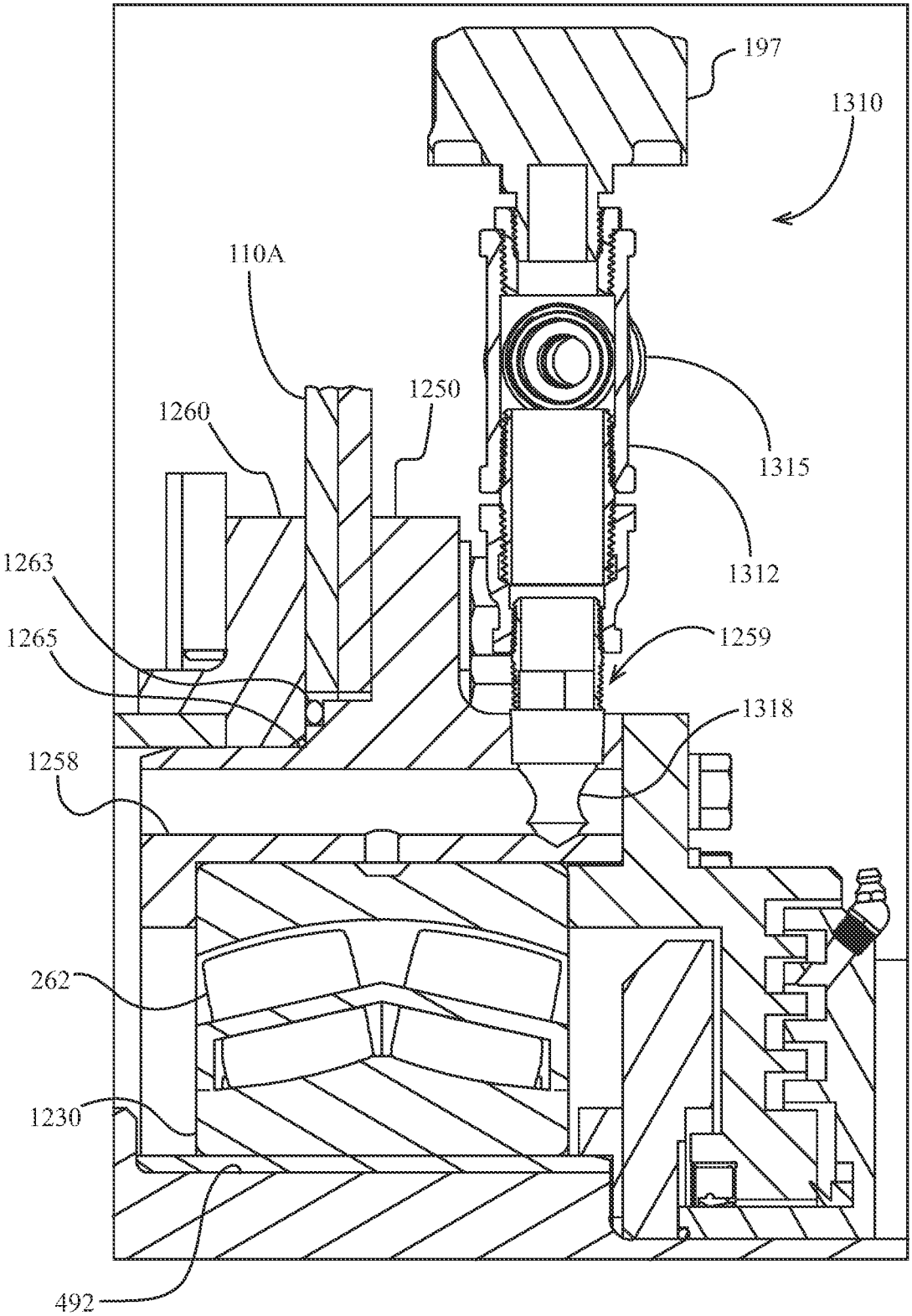
FIG. 13 is an enlarged view of a portion of FIG. 12.

In an exemplary embodiment illustrated in FIG. 11, the fluid coupling 1100 is optionally in fluid communication with a coupler 1327 of the level indicator assembly 1320 such as by a conduit 1340 (e.g., a flexible conduit). The coupler 1327 is optionally in fluid communication with a level indicator 195 which is optionally supported on the sidewall 110A (e.g., by a bracket 1328). A coupler 1325 is optionally in fluid communication with the level indicator 195. The coupler 1325 is optionally in fluid communication with a coupler 1315 of the breather assembly 1310 (e.g., via a conduit 1330 such as a flexible conduit). The coupler 1315 is optionally in fluid communication with the breather 197 such as through a tee 1312. Referring to FIGS. 12 and 13, the tee 1312 is optionally also in fluid communication with the interior volume of the housing 270, e.g., an upper end and/or air space thereof. In some embodiments, a nipple 1318 in fluid communication with the tee 1312 extends into an opening 1258 (e.g., an axial opening oriented parallel to rotational axis R which may be defined by the bearing assembly 1200 and/or the shaft) in a bearing housing 1250; the opening 1258 is optionally in fluid communication with the interior volume of the housing 270. The breather assembly 1310 is optionally supported on the bearing housing 1250; for example, the nipple 1318 may be supported in an opening 1259 (e.g., an opening extending vertically and/or extending along a radial direction Dr-a normal to the rotational axis R). The breather assembly 1310 may be disposed at an upper end of the bearing housing.

Figure 14:
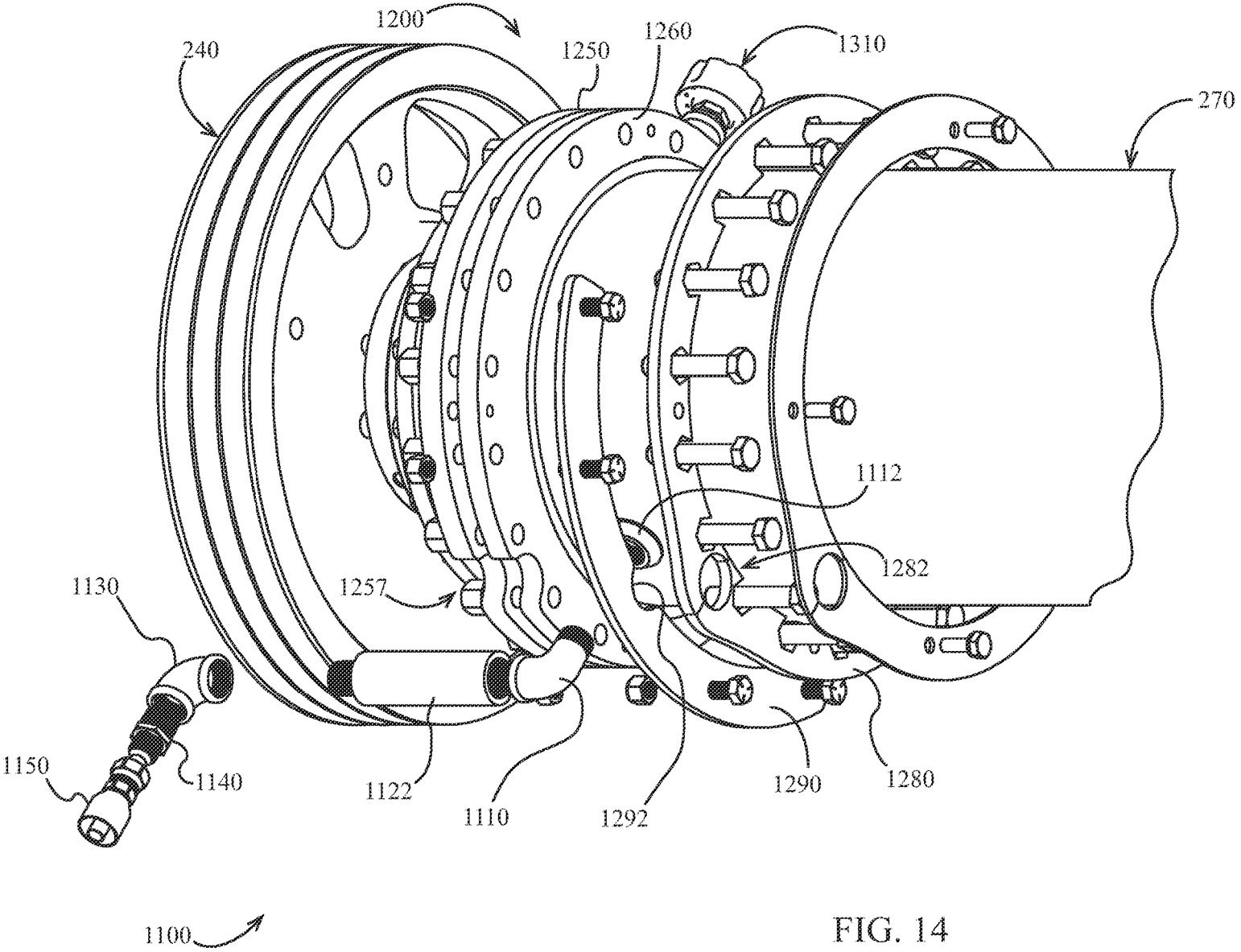
FIG. 14 is a partial exploded perspective view of the classifier of FIG. 11.

Referring to FIGS. 12-14, the bearing assembly 1200 optionally comprises a bearing 1230 in which a plurality of roller elements 262 are rollingly supported. The shaft 400 (e.g., an annular shoulder 492 thereof) is optionally operably (e.g., rotatably) supported on the bearing 1230. The bearing 1230 is optionally supported at least partially in or adjacent to an opening in the sidewall 110A. In some embodiments, bearing housing 1250 supports and/or surrounds the bearing 1230. The bearing housing 1250 optionally extends at least partially through an opening in sidewall 110A. A clamping ring 1260 optionally at least partially surrounds a portion of the bearing housing 1250 which extends through the opening in sidewall 110A. The clamping ring 1260 and bearing housing 1250 are optionally clamped together (e.g., by the use of fasteners such as nut-and-bolt assemblies) on opposing sides of the sidewall 110A.

In some embodiments, a bearing housing retention plate 1280 is clamped (e.g., by fasteners such as bolts) to the bearing housing 1250 and/or to the clamping ring 1260. The bearing housing retention plate 1280 optionally substantially surrounds the housing 270. In some embodiments, a housing retention plate 1290 is mounted directly or indirectly (e.g., using fasteners such as bolts) to the sidewall 110A. In some embodiments, the housing retention plate 1290 extends circumferentially around a lower portion of the housing 270 and optionally at least partially supports the housing 270.

Referring to FIG. 12, an embodiment of the fluid coupling 1100 (which may be referred to as a lubricant drain) is illustrated. The fluid coupling 1100 is optionally in fluid communication with an opening 278 in housing 270. The opening 278 is optionally disposed at or near the bottom of the housing 270. The fluid coupling 1100 optionally includes a flange 1112 which is coupled (e.g., by welding) to the opening 278. An inlet coupling 1110 (e.g., a conduit such as an angled conduit) is optionally fluidly coupled to the flange 1112 (e.g., by threading an inlet end of the inlet coupling 1110 into the flange 1112). An intermediate coupling 1120 (e.g., a conduit such as a horizontally extending conduit) is optionally fluidly coupled to the inlet coupling 1110 (e.g., by threading an outlet end of the inlet coupling 1110 into an inlet end of the intermediate coupling 1120). In some embodiments, the intermediate coupling 1120 optionally extends through an opening 112 in sidewall 110A. In some embodiments, a sleeve 1122 (e.g., made of plastic or other material which may be wear resistant material such as ultra-high molecular weight polyethylene) is disposed between the intermediate coupling 1120 and the opening 112 (e.g., slidingly received on the intermediate coupling and/or slidingly received in the opening 112). In some embodiments, an outlet coupling 1130 (e.g, a conduit such as an angled conduit) is optionally fluidly coupled to the intermediate coupling 1120 (e.g., by threading an outlet end of the intermediate coupling into an inlet end of the outlet coupling). A coupling 1140 (e.g., a reducer or other coupling) optionally fluidly couples the outlet coupling to a coupler 1150. The coupler 1150 is optionally coupled fluidly coupled to the conduit 1340 described herein with respect to FIG. 11.

In some embodiments, the bearing housing retention plate 1280 includes an opening 1282 through which the intermediate coupling 1120 optionally at least partially extends. In some embodiments, the bearing housing retention plate 1280 at least partially supports the fluid coupling 1100.

In some embodiments, the housing retention plate 1290 includes a notch 1292 (or opening in some embodiments) through which the intermediate coupling 1120 optionally at least partially extends. The housing retention plate 1290 optionally at least partially supports the fluid coupling 1100.

In some embodiments, the fluid coupling 1100 (e.g., the intermediate coupling 1120 thereof) extends through the sidewall 110 at a position at least partially radially outward (e.g., along radial direction Dr-b) of the housing 270. The intermediate coupling 1120 optionally extends through the sidewall 110 at a position at least partially radially outward (e.g., along radial direction Dr-b) of the bearing housing 1250 and/or the clamping ring 1260. In some embodiments, a notch 1257 is formed in a radially outer (e.g., lowermost) end of the bearing housing 1250; in some embodiments, the intermediate coupling 1120 extends at least partially through the notch 1257.

In some embodiments, the opening 278 is disposed at least partially outboard of a vertical plane Pt. The plane Pt is disposed at an outboard end of central portion 450 of the shaft 400. The central portion 450 optionally has a greater circumference than a shoulder 452 (e.g., annular shoulder) of the shaft 400 disposed outboard of the central portion 450. The shoulder 452 is optionally concentric with the rotational axis R. The opening 278 is optionally disposed at least partially below the shoulder 452.

Referring to FIG. 12, in some embodiments a nipple 1272 is inserted (e.g., through a radially extending opening in bearing housing 1250) into an opening 1256 (e.g., axially extending opening) in the bearing housing 1250. The opening 1256 is optionally in fluid communication with the interior volume of the housing 270 (e.g., with a lower portion of the interior volume). In some embodiments a plug 1270 is coupled to the nipple 1272; the plug may optionally be removed or adjusted in a maintenance mode.

Referring to FIG. 13, in some embodiments, a first o-ring 1263 is disposed between a face of clamping ring 1260 and an opposing face of bearing housing 1250. In some embodiments a second o-ring 1265 is disposed between a chamfer of clamping ring 1260 and a corner defined by two surfaces (e.g., a radially outward-facing surface and an axially inboard-facing surface) of the bearing housing 1250.

Shaft Embodiments

Referring to FIGS. 3 through 7, the shaft 400 is illustrated in more detail. The central portion 450 is optionally cylindrical. The central portion 450 is optionally coaxial with the shoulders 492. The central portion 450 is optionally coaxial with rotational axis R of the shaft 400. In some embodiments, one or more weights 410 (e.g., eccentric weights) are mounted (e.g., removably mounted) to the central portion 450.

Figure 4:
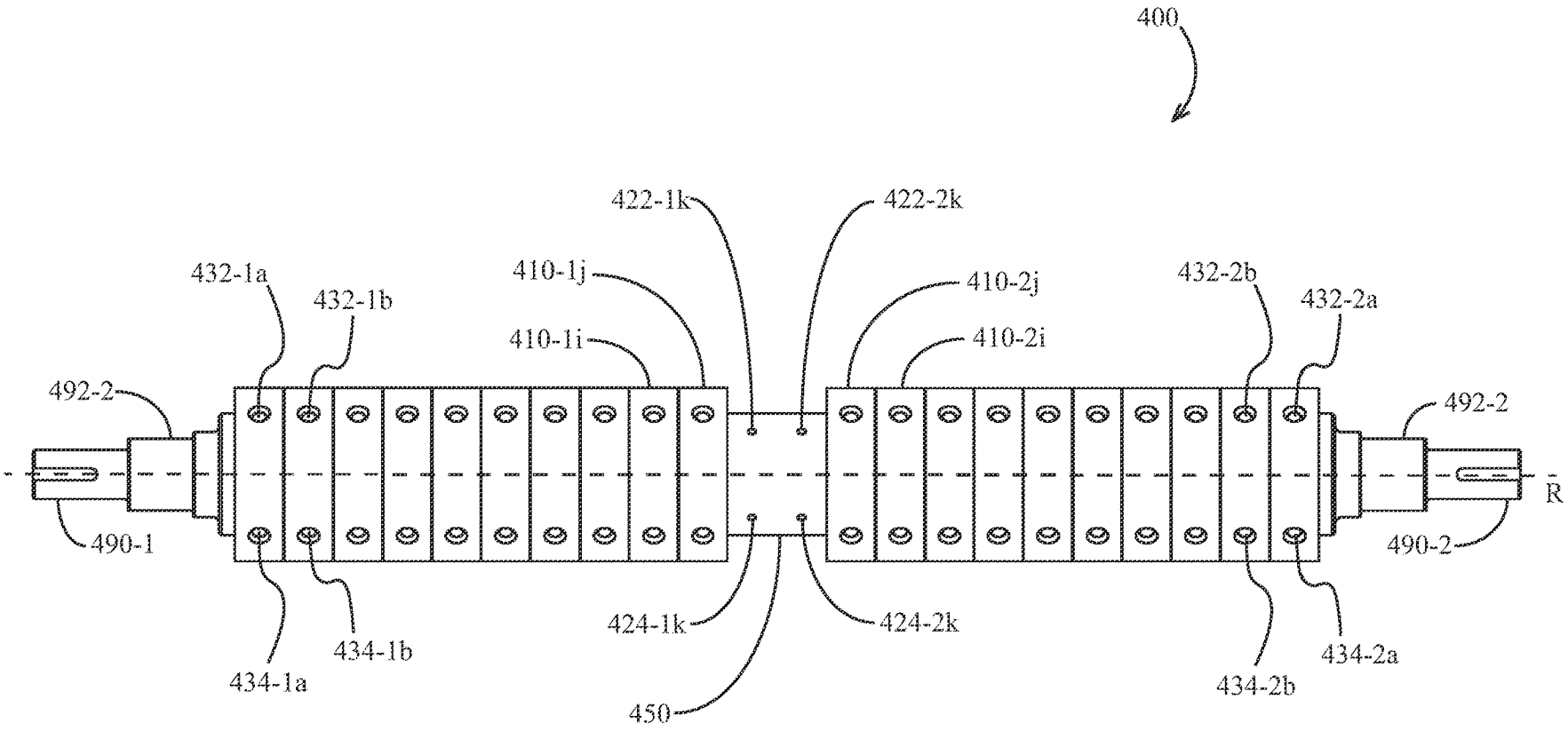
FIG. 4 is a bottom view of the eccentric shaft assembly of FIG. 3.
Figure 6:
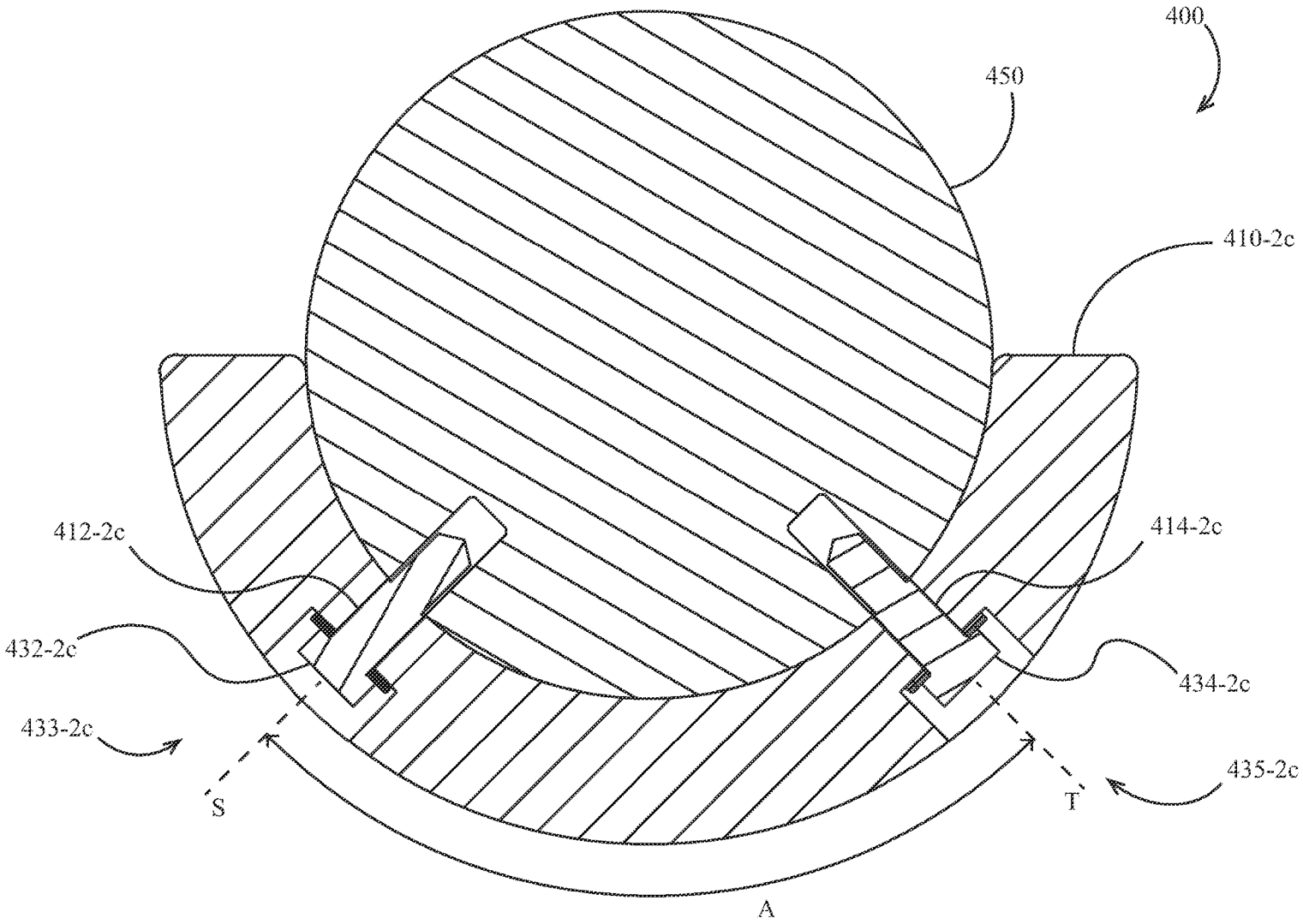
FIG. 6 is a cross-sectional view along the section 6-6 of FIG. 3.
Figure 7:
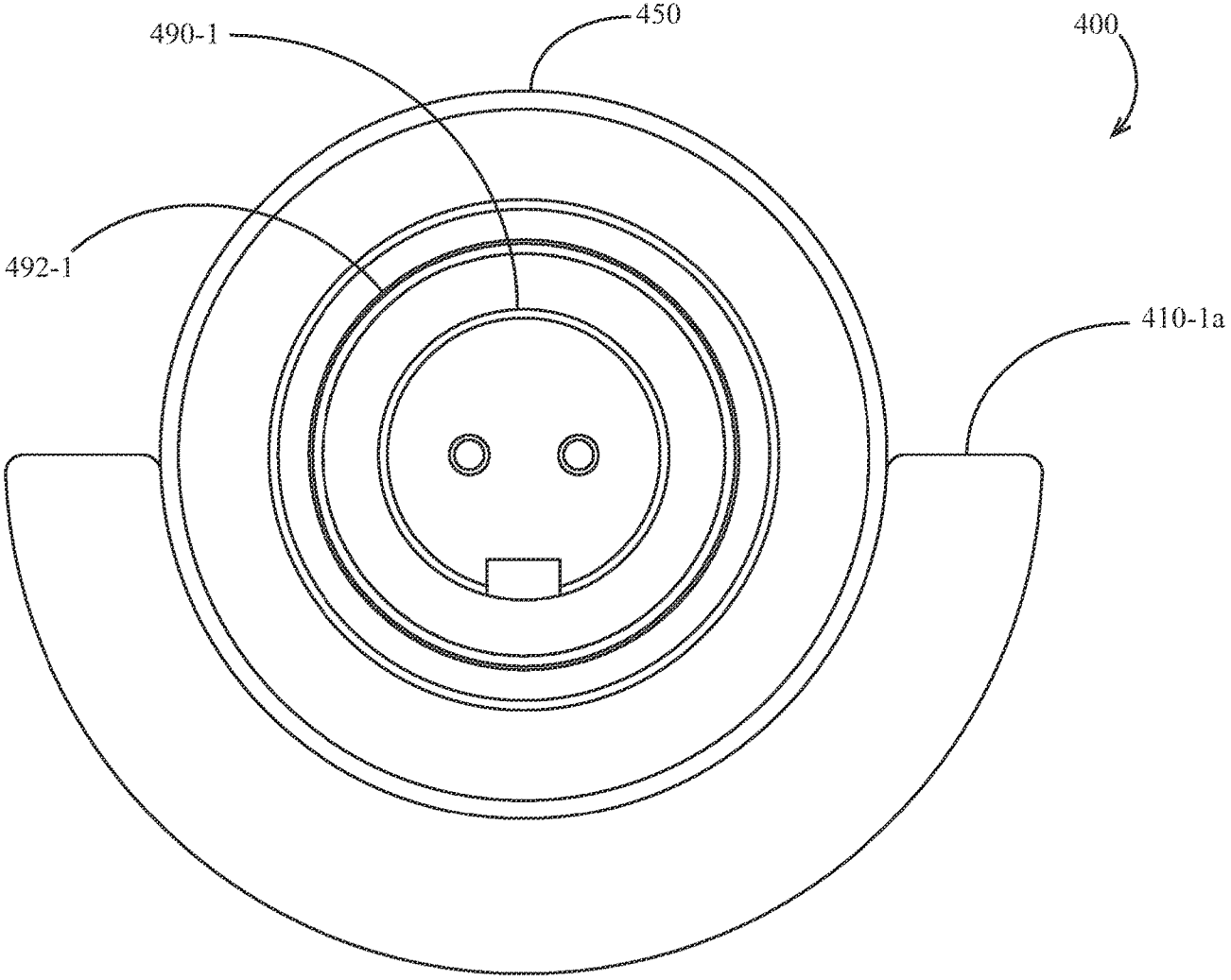
FIG. 7 is a side elevation view of the eccentric shaft assembly of FIG. 3.

Referring to FIG. 4, each weight 410 is optionally mounted by one or more fasteners such as bolts (e.g., a first bolt 432 and second bolt 434). The bolts 432, 434 are optionally removably mounted (e.g., threaded) into corresponding openings (e.g., threaded openings) 422, 424 in the central portion 450. Referring to FIG. 6, the head of each bolt 432 (and in some embodiments an associated washer) is optionally seated on a surface 433 (e.g., a flat surface) of the associated weight 410. The head of each bolt 434 is optionally seated on a surface 435 (e.g., a flat surface) of the associated weight 410. Openings 412, 414 optionally extend from surfaces 433, 435, respectively to an opposing (e.g., inner) surface of the weight 410 for receiving the bolts 432, 434, respectively therethrough. The surfaces 433, 435 are optionally recessed into the weight 410 as illustrated. The openings 422, 424 (and/or corresponding openings 412, 414) have central longitudinal axes S and T, respectively which optionally extend through the rotational axis R of the shaft 400 and/or through the central axis of the central portion 450. The axes S and T are optionally offset by an angle A which may be measured on the plane normal to the rotational axis. The angle A is optionally between 80 and 100 degrees (e.g., approximately 90 degrees, 90 degrees, between 85 and 95 degrees). In various other embodiments, the angle A is between 30 and 190 degrees, approximately 180 degrees, 180 degrees, 45 degrees, approximately 45 degrees, or between 30 and 60 degrees. In the illustrated embodiment, the angle A is approximately 90 degrees. In the illustrated embodiment, constant-speed rotation of the shaft 400 results in both tensile and a shear forces on the bolts 432, 434. In other embodiments, constant-speed rotation of the shaft 400 results in primarily or exclusively tensile forces on the bolts 432, 434.

Referring to FIG. 6, the weights 410 are optionally eccentric; e.g., when installed to the central portion 450, the weights 410 optionally have a center of gravity offset from the rotational axis R and/or the central axis of the central portion 450. Thus rotation (e.g., constant-speed rotation) of the shaft 400 optionally causes the classifier 100 to vibrate (e.g., along a circular, elliptical, linear, or other throw path according to various embodiments).

In the illustrated embodiment, the weight 410 extends approximately 180 degrees around the circumference of the central portion 450. In other embodiments, the weight 410 extends more than 180 degrees around the circumference of the central portion 450; in such embodiments, the weight 410 is optionally slidingly received on the central portion 450. In other embodiments, the weight 410 extends less than 180 degrees around the circumference of the central portion 450 (e.g., between 30 and 180 degrees, between 60 and 180 degrees, between 90 and 180 degrees). In still other embodiments, a first weight is attached to a first opening 422 and a second, separate weight is attached to a second opening 422; in various such embodiments, the first and second weights may be disposed adjacent one another, contacting one another, separate from one another, and/or on circumferentially opposing sides of the central portion 450.

Figure 5:
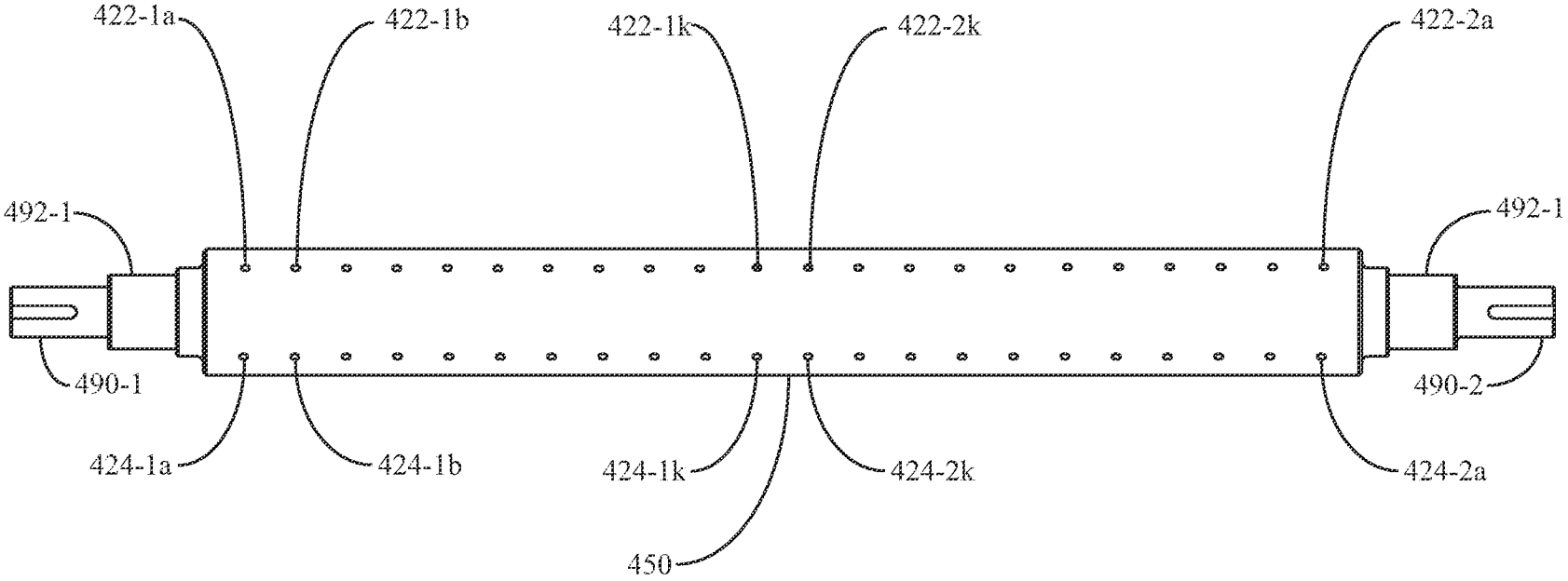
FIG. 5 is a bottom view of an embodiment of a shaft of the eccentric shaft assembly of FIG. 3.

Referring to FIGS. 4 and 5, the shaft 400 is shown with and without a plurality of weights 410 attached thereto. It should be appreciated that the weight of shaft 400 can be customized by attaching a customized number of weights 410 (and/or by replacing one or more weights 410 with another weight having a different weight, shape or material). Increasing weight of shaft 400 may result in a greater throw (e.g., amplitude of vibration) through which the shaft 400 oscillates at a given speed and overall classifier size and/or weight. In some implementations, a relatively greater weight of shaft 400 may be selected for a classifier having relatively a large size and/or weight.

In the illustrated embodiment, the central portion 450 includes a first array of openings 422-1*a* through 422-1*k*. The central portion 450 optionally includes a second array of openings 422-2*a* through 422-2*k*. The first and second arrays of openings 422-1, 422-2 are optionally aligned along a transversely-extending axis. The central portion optionally includes a third array of openings 424-1*a* through 424-1*k*. The central portion 450 optionally includes a fourth array of openings 424-2*a* through 424-2*k*. The third and fourth arrays of openings 424-1, 424-2 are optionally aligned along a transversely-extending axis. Each pair of openings 422, 424 are optionally aligned along an axis normal to the rotational axis R.

In the illustrated embodiment, a first plurality of weights 410-1*a* through 410-1*j* is mounted to a first subset of the openings 422, 424 in the first and second opening arrays. A second plurality of weights 410-2*a* through 410-2*j* is mounted to a second subset of openings 422, 424 in the first and second opening arrays. The first and second pluralities of weights 410 are optionally disposed symmetrically about a central transverse plane of the central portion. In order to modify the weight of the shaft 400 and/or the throw (e.g., vibratory amplitude) or vibratory path of the classifier 100, one or more weights 410 may be added or removed and/or replaced with different weights.

In the illustrated embodiment, the surface of central portion 450 to which the weights 410 are attached is generally semi-cylindrical and is optionally radially centered on the rotational axis R of the shaft 400. In other embodiments, the central portion 450 may include a flat surface or surface having a different profile to which one or more weights 410 are attached.

In some embodiments, the central axes of bolts 432 do not pass through the rotational axis R. In some embodiments, the weights 410 are attached other than by bolts, e.g., by being secured by a removable fastener in a slot or other receiving portion of the central portion 450.

It should be appreciated that in various embodiments, the central portion 450 need not be disposed precisely in the center of the shaft 400; for example, the shoulders 492-1 and 492-2 may differ in transverse length or the ends 490-1 and 490-2 may differ in transverse length.

In some embodiments, the classifier 100 may be a self-standing unit having its material input and/or output conveyed by belt conveyors or other devices. The classifier 100 may be mobile (e.g., supported on wheels, tracks or skids) or stationary. The classifier may be incorporated in a plant (e.g., a mobile or stationary plant) including other devices such as wet classifiers (e.g., hydrocyclones), crushers (e.g., cone crushers, gyratory crushers, jaw crushers, impact crushers), or other classifying or conveying equipment.

Any ranges recited herein are intended to inclusively recite all values within the range provided in addition to the maximum and minimum range values. Headings used herein are simply for convenience of the reader and are not intended to be understood as limiting or used for any other purpose.

Although various embodiments have been described above, the details and features of the disclosed embodiments are not intended to be limiting, as many variations and modifications will be readily apparent to those of skill in the art. Accordingly, the scope of the present disclosure is intended to be interpreted broadly and to include all variations and modifications within the scope and spirit of the appended claims and their equivalents. For example, any feature described for one embodiment may be used in any other embodiment.

The invention claimed is:

1. A vibratory material classifier, comprising:

first and second sidewalls;

a screening deck operably supported by said first and second sidewalls;

a first bearing assembly supported by said first sidewall, said first bearing assembly having a rotational axis;

a second bearing assembly supported by said second sidewall;

an eccentric shaft operably supported by said first and second sidewalls;

a housing, said housing being at least partially surrounding said eccentric shaft, said housing having an interior volume, said housing configured to contain a quantity of lubricant in said interior volume, said housing configured to isolate said quantity of lubricant from said screening deck;

a fluid coupling, said fluid coupling comprising:

a first end disposed between the first and second sidewalls, said first end being in fluid communication with said interior volume of said housing; and a second end disposed outside of said first and second sidewalls, wherein said fluid coupling passes through said first sidewall at a position radially outward of said housing along a radial direction, said radial direction being normal to said rotational axis.

2. The vibratory material classifier of claim 1, wherein said fluid coupling further comprises an intermediate coupling, said intermediate coupling comprising a conduit in fluid communication with said first end and said second end, wherein said intermediate coupling is disposed radially outward of said housing along said radial direction.

3. The vibratory material classifier of claim 2, wherein said eccentric shaft passes through a first opening in said first sidewall, wherein said intermediate coupling of said fluid coupling extends through a second opening in said first sidewall, wherein said second opening is radially outward of said first opening along the radial direction.

4. The vibratory material classifier of claim 2, wherein said first bearing assembly comprises a plurality of bearing elements circumferentially arranged about said rotational axis, wherein said first bearing assembly comprises a bearing housing supported by the first sidewall, wherein said first bearing assembly comprises a bearing housing retention plate coupled to said bearing housing, wherein said intermediate coupling of said fluid coupling extends through said bearing housing retention plate.

5. The vibratory material classifier of claim 2, wherein said first bearing assembly comprises a plurality of bearing elements circumferentially arranged about said rotational axis, wherein said first bearing assembly comprises a bearing housing supported by the first sidewall, wherein said intermediate coupling of said fluid coupling is disposed at least partially radially outward of said bearing housing along the radial direction.

6. The vibratory material classifier of claim 1, wherein said first end of said fluid coupling is disposed at or adjacent to a lower end of said housing, whereby lubricant flows from said interior volume into said fluid coupling.

7. The vibratory material classifier of claim 1, wherein said fluid coupling is in fluid communication with a lubricant opening in said housing, and wherein said lubricant opening is disposed at least partially outboard of an eccentric portion of the eccentric shaft.

8. The vibratory material classifier of claim 1, further comprising a level indicator in fluid communication with said fluid coupling.

9. The vibratory material classifier of claim 8, wherein said level indicator is disposed vertically higher than said position at which said fluid coupling passes through said first sidewall.

10. The vibratory material classifier of claim 1, wherein said screening deck is inclined with respect to a horizontal plane.

11. The vibratory material classifier of claim 3, further comprising:

a port, said port being in fluid communication with an upper portion of said housing, said port being in fluid communication with said fluid coupling.

12. The vibratory material classifier of claim 11, wherein said port is supported on a bearing housing.

13. The vibratory material classifier of claim 11, wherein said port is in fluid communication with a breather.

14. The vibratory material classifier of claim 1, wherein said eccentric shaft comprises a central portion, wherein said eccentric shaft comprises a plurality of weights removably mounted to said central portion.

15. The vibratory material classifier of claim 14, wherein said central portion of said eccentric shaft is generally circular, and wherein at least one of said weights comprises an arcuate surface configured to be removably mounted to said central portion.

16. A vibratory material classifier, comprising:

first and second sidewalls;

screen media operably supported by said first and second sidewalls, said screen media being disposed at least partially between said first and second sidewalls;

a first bearing assembly supported by said first sidewall;

a second bearing assembly supported by said second sidewall, wherein said first and second bearing assemblies have a common rotational axis;

an eccentric shaft operably supported by said first and second sidewalls;

a housing disposed about at least part of said eccentric shaft, said housing having an interior volume, said housing configured to contain a quantity of lubricant in said interior volume, said housing configured to isolate said quantity of lubricant from said screening deck;

a conduit, said conduit comprising:

a first end disposed between the first and second sidewalls, said first end in fluid communication with said interior volume of said housing;

a second end disposed outside of said first and second sidewalls; and an intermediate portion, said intermediate portion being in fluid communication with said first end and said second end, wherein said intermediate portion is disposed radially outward of said housing along a radial direction, said radial direction extending normal to said common rotational axis.

17. The vibratory material classifier of claim 16, wherein said intermediate portion extends at least partially through an opening in said first sidewall.

18. The vibratory material classifier of claim 16, further comprising:

a breather, said breather being in fluid communication with said housing.

19. The vibratory material classifier of claim 16, wherein said first bearing assembly comprises a flange supported by the first sidewall, wherein said intermediate portion of said conduit extends through said flange.

20. A method of transferring lubricant from a vibratory material classifier, comprising:

operably supporting a screening deck between first and second sidewalls;

rotating an eccentric shaft on a rotational axis to drive vibration of a pair of first and second sidewalls and said screening deck;

containing a volume of lubricant in a housing at least partially surrounding said eccentric shaft;

transferring a portion of said volume of lubricant along a lubricant path isolated from said screening deck, said lubricant path comprising:

a first path portion between said first and second sidewalls and extending generally away from said housing;

a second path portion extending through one of said first and second sidewalls, said second path portion being at least partially radially outward of said housing along a radial direction, said radial direction being normal to said rotational axis; and a third path portion not between first and second sidewalls.

* * * * *